US010053340B2

(12) United States Patent
Albinger et al.

(10) Patent No.: US 10,053,340 B2
(45) Date of Patent: Aug. 21, 2018

(54) SYSTEM AND METHOD FOR CONNECTING A CRANE SUSPENSION ASSEMBLY TO A SUPPORT COLUMN

(71) Applicant: Manitowoc Crane Companies, LLC, Manitowoc, WI (US)

(72) Inventors: Timothy J. Albinger, Manitowoc, WI (US); Joseph R. Rucinski, Manitowoc, WI (US); Derrick L. Geiser, Manitowoc, WI (US); Ryan M. Fickau, Manitowoc, WI (US); Ian M. Moore, Manitowoc, WI (US)

(73) Assignee: Manitowoc Crane Companies, LLC, Manitowoc, WI (US)

( * ) Notice: Subject to any disclaimer, the term of this patent is extended or adjusted under 35 U.S.C. 154(b) by 97 days.

(21) Appl. No.: 14/600,570

(22) Filed: Jan. 20, 2015

(65) Prior Publication Data

US 2015/0203338 A1 Jul. 23, 2015

Related U.S. Application Data

(60) Provisional application No. 61/929,366, filed on Jan. 20, 2014, provisional application No. 61/947,303, filed on Mar. 3, 2014.

(51) Int. Cl.
*B66C 23/70* (2006.01)
*B66C 23/82* (2006.01)

(52) U.S. Cl.
CPC ..... *B66C 23/70* (2013.01); *B66C 23/821* (2013.01); *Y10T 29/49826* (2015.01)

(58) Field of Classification Search
CPC ..... B66C 23/70; B66C 23/821; B66C 23/823; Y10T 29/49826

(Continued)

(56) References Cited

U.S. PATENT DOCUMENTS 3,125,227 A * 3/1964 Kauffman et al. ..... B66C 23/66 212/177
4,159,776 A * 7/1979 Holter ..... B66C 23/82 212/239

(Continued)

FOREIGN PATENT DOCUMENTS

CN 85205821 U 8/1986
CN 201047419 4/2008

(Continued)

OTHER PUBLICATIONS

International Search Report and Written Opinion for International Application No. PCT/US2015/018504, dated Jun. 10, 2015 (12 pages).

(Continued)

*Primary Examiner* — Michael E Gallion
(74) *Attorney, Agent, or Firm* — Ramey & Schwaller, LLP

(57) ABSTRACT

An intermediate suspension connection column segment designed for use in constructing a column which is supported by a suspension that includes a first end having a first connection configured to connect to a first adjacent column segment; a second end opposite the first end, the second end having a second connection configured to connect to a second adjacent column segment; and an intermediate suspension connection between the first connection and the second connection, the intermediate suspension connection configured to couple an intermediate suspension between the suspension and the column.

12 Claims, 16 Drawing Sheets

(58) Field of Classification Search
USPC ..... 212/347
See application file for complete search history.

(56) References Cited

U.S. PATENT DOCUMENTS

| | | | | |
|---|---|---|---|---|
| 4,431,109 | A * | 2/1984 | Behrendt | B66C 23/702 212/177 |
| 4,492,312 | A * | 1/1985 | Poock | B66C 23/823 212/227 |
| 4,557,391 | A * | 12/1985 | Poock | B66C 23/823 212/256 |
| 4,575,132 | A | 3/1986 | Nattel | |
| 4,585,132 | A * | 4/1986 | Rathe | B66C 23/823 212/264 |
| 4,850,161 | A | 7/1989 | McGinnis | |
| 4,858,890 | A * | 8/1989 | Fowler | B66C 23/208 212/179 |
| 4,976,361 | A * | 12/1990 | Becker | B66C 23/823 212/231 |
| 4,982,853 | A * | 1/1991 | Kishi | B66C 23/701 212/230 |
| 5,799,807 | A * | 9/1998 | Hamme | B66C 23/823 212/232 |
| 5,803,279 | A * | 9/1998 | Stallbaumer | B66C 23/823 212/230 |
| 6,065,621 | A * | 5/2000 | Fatemi | B66C 23/48 212/264 |
| 6,550,624 | B1 * | 4/2003 | Irsh | B66C 23/702 212/231 |
| 7,172,082 | B2 * | 2/2007 | Irsch | B66C 23/828 212/231 |
| 8,690,517 | B1 * | 4/2014 | Perrault | B29C 66/65 414/22.62 |
| 2004/0060887 | A1 | 4/2004 | Willim | |
| 2004/0129663 | A1 | 7/2004 | Willim | |
| 2006/0016775 | A1 * | 1/2006 | Willim | B66C 23/825 212/347 |
| 2008/0116161 | A1 * | 5/2008 | Kurotsu | B66C 23/82 212/262 |
| 2010/0243595 | A1 * | 9/2010 | Walker | B66C 23/26 212/294 |
| 2010/0294735 | A1 * | 11/2010 | Walker | B66C 23/82 212/232 |
| 2010/0326004 | A1 * | 12/2010 | Daas | B66C 23/70 52/646 |
| 2011/0132860 | A1 | 6/2011 | Bohnacker et al. | |
| 2012/0175333 | A1 * | 7/2012 | Pech | B66C 23/82 212/177 |
| 2012/0265411 | A1 * | 10/2012 | Deng | B66C 23/823 701/50 |
| 2014/0061144 | A1 * | 3/2014 | Terauchi | B66C 23/70 212/177 |
| 2014/0231374 | A1 * | 8/2014 | Foust | B66C 23/70 212/347 |
| 2014/0284364 | A1 * | 9/2014 | Neuffer | F16M 13/02 224/401 |
| 2017/0073201 | A1 * | 3/2017 | Moore | B66C 23/823 |

FOREIGN PATENT DOCUMENTS

| | | | |
|---|---|---|---|
| CN | 102001590 | A | 4/2011 |
| CN | 103112786 | A | 5/2013 |
| DE | 1428788 | A1 | 6/2004 |
| DE | 20 2004 00808 | U1 | 9/2005 |
| EP | 1 428 788 | A1 | 6/2004 |
| JP | 57187919 | | 5/1984 |
| JP | 1986266814 | A | 11/1986 |
| JP | 1999236188 | A | 8/1998 |
| NL | 1022902 | C2 | 9/2004 |

OTHER PUBLICATIONS

International Search Report and Written Opinion for International Application No. PCT/US2015/011969, dated May 1, 2015 (15 pages).

Office Action dated Jun. 27, 2017, in Japanese Patent Application No. 2016-547553 filed Jan. 20, 2015 with English translation.

Office Action dated Sep. 27, 2017, in Chinese Application No. 201580022550.6, filed Mar. 3, 2015.

Office Action dated Jun. 2, 2017, in Chinese Application No, 201580015161, filed Sep. 20, 2016.

Office Action dated Sep. 5, 2017, in Japanese Application No. 2016555740, filed Sep. 5, 2016.

Extended European Search Report dated Sep. 26, 2017, in European Application No. 15737315.0, filed Jul. 19, 2016.

Search Report dated Jun. 2, 2017, in Chinese Application No. 201580015161, filed Sep. 20, 2016.

Non-Final Office Action dated May 10, 2018, in Chinese Application No. 201580022550.6.

* cited by examiner

SYSTEM AND METHOD FOR CONNECTING A CRANE SUSPENSION ASSEMBLY TO A SUPPORT COLUMN

REFERENCE TO EARLIER FILED APPLICATION

This application claims the benefit under 35 U.S.C. § 119(e) of U.S. Provisional Patent Application No. 61/929,366, filed Jan. 20, 2014, and titled "SYSTEM AND METHOD FOR CONNECTING A CRANE SUSPENSION ASSEMBLY TO A SUPPORT COLUMN," and U.S. Provisional Patent Application No. 61/947,303, filed Mar. 3, 2014, and titled "SYSTEM AND METHOD FOR CONNECTING A CRANE SUSPENSION ASSEMBLY TO A SUPPORT COLUMN," which are incorporated, in their entirety, by this reference.

BACKGROUND

The present invention relates to systems and methods for connecting a crane suspension assembly to a support column on a crane. More particularly the present invention relates to systems and method for connecting a pendant to an intermediate location on a crane boom.

Lift cranes typically include a carbody; ground engaging members elevating the carbody off the ground; a rotating bed rotatably connected to the carbody such that the rotating bed can swing with respect to the ground engaging members; and a boom pivotally mounted on the rotating bed, with a load hoist line extending there from. For mobile lift cranes, there are different types of moveable ground engaging members, most notably tires for truck mounted cranes, and crawlers. Typically mobile lift cranes include a counterweight to help balance the crane when the crane lifts a load. Typical cranes include a boom suspension that is used to change the angle of the boom and provide tension forces to offset the forces applied to the boom by the load on the load hoist line so that the boom can behave as a column member with only compressive forces acting through the length of the boom.

Typical cranes are designed to be set up with different boom length configurations to optimize the capacity that the crane can handle, only using as long of a boom as is necessary for a particular lift operation that the crane is being set up for. Since the boom length will vary between different configurations, the boom suspension also has to be designed to accommodate different boom lengths. Typically the boom suspension includes multiple sections of suspension members that are connected together, sometimes referred to as boom backstay straps, which connect between the top of the boom and either an equalizer suspended between the boom and a fixed mast, or between the boom and the top of a live mast. The suspension member may be rigid such as steel bars or may be flexible such as wire or synthetic rope. On a crane with a relatively long boom, the suspension may additionally be connected to the boom at an intermediate location less than the top of the boom. On a typical crane with a fixed mast, the boom hoist rigging has multiple parts of line that run between the equalizer and the top of the mast, and is used to control the angle of the boom.

Since the crane will be used in various locations, it needs to be designed so that it can be transported from one job site to the next. This usually requires that the crane be dismantled into components that are of a size and weight that they can be transported by truck within highway transportation limits. The ease with which the crane can be dismantled and set up has an impact on the total cost of using the crane. Thus, to the extent that fewer man-hours are needed to set up the crane, there is a direct advantage to the crane owner or renter.

It is convenient to transport the sections of the boom straps and jib backstay straps with the sections of boom between one job site and the next. This is because, for the most part, the number of sections and the length of each section of the boom straps and the jib backstay straps that will be needed are dependent on the number and lengths of the boom sections that are used to construct the boom. For example, a 100 foot boom may be made from a 10 foot boom butt, a 10 foot boom top and four 20 foot boom inserts. However, if the boom is going to be 120 feet long, five 20 foot boom inserts will be used. If the boom is going to be 130 feet long, five 20 foot inserts and one 10 foot insert will be used.

A typical boom insert has connectors at each end for connection to an adjacent crane section. The connectors are typically tabs having an aperture for receiving a pin. A boom insert may have complementary connectors at each end of the boom insert. For example, a near end of the boom insert may have single tabs with an aperture. A far end of the boom insert may use sets of tabs spaced apart by the thickness of the tab on the first end. Thus when the boom inserts are placed together end to end, the single tab of the first end may be orientated between the two tabs of the second end with their apertures aligned. A pin is then inserted through the apertures coupling the boom inserts together. To aid in alignment of the boom inserts during assembly, the tabs on an upper side of a boom insert may be replaced by bracket and pin. The far end of the boom insert may have a bracket on the upper side with the bracket opening upward. The near end of the boom insert may have a horizontal pin complementary to the bracket. Two boom connections may then be assembled by joining the bracket and pin with the boom inserts angled relative to one another. Then, with the pin in the bracket, the boom insert is rotated until the tabs on the lower section are aligned. A pin is then inserted into the aperture of the tabs and the boom sections are coupled together.

When an intermediate suspension connection to the suspension is required, an intermediate suspension connector such as a pendant assembly is used to join the suspension to the boom. The pendant assembly connects to the boom at the connection between adjacent boom inserts. Typically, the lower pins are replaced by longer pins. The pendant assembly has tabs on its lower end that are spaced apart the width of the outer tabs of the boom insert. Thus when the boom is assembled, the boom inserts are coupled together as described previous with the exception that the pendant assembly is placed over the tabs of the boom insert. Apertures in the pendant tabs are aligned with the apertures in the boom insert tabs and the longer pin is inserted through the pendant tabs and the boom insert's tabs. The longer pin couples the boom inserts together along with the pendant assembly.

The described system of attaching a pendant assembly to a boom is advantageous in that it requires no special parts other than the pendant assembly and the longer pins. If the pendants assembly is not required, it is simply not attached between boom sections. However, assembly of the crane sections is complicated by the additional alignment necessary with the pendant assembly. Also, because the pendant assembly is a separate component, there exists the possibility that the pendant assembly may be lost or unavailable when assembling the boom. The assembly of the boom cannot be completed until the pendant is in place. Therefore there would be a great benefit if it were possible to attach the boom to the suspension using a method that did not require a pendent coupled to the ends of a boom. Further, by simplifying the connection of the boom inserts when a pendant is required, the amount of time it takes to assemble a boom may be shortened and potential delays reduced.

BRIEF SUMMARY

Embodiments of the invention are directed to an intermediate suspension connection column segment for use in constructing a column which is supported by a suspension. The segment includes a first end having a first connection configured to connect to a first adjacent column segment and a second end opposite the first end with the second end having a second connection configured to connect to a second adjacent column segment. An intermediate suspension connection is disposed between the first connection and the second connection with the intermediate suspension connection configured to couple an intermediate suspension between the suspension and the column.

In another embodiment of the invention a column assembly includes a plurality of column segments coupled end to end with at least one column segment being the described intermediate suspension connection column segment. A suspension is attached to the column adjacent the top of the column.

In another embodiment of the invention, a crane has a column formed of a plurality of column segments coupled end to end with at least one column segment being the previously described intermediate suspension connection column segment. A mast extends laterally from the column and a plurality of suspension members couple the mast to an end of the column. At least one pendant is connected to the intermediate suspension connection and at least two suspension members from among the plurality of suspension members.

Embodiments of the invention are further directed to a method for erecting a crane. In the method at least three boom segments are assembled end to end. At least one of the boom segments has an intermediate suspension connection between the ends of the segment. The at least boom segments are coupled end to end to form a column assembly. A first end of the column assembly is coupled to a pivot point. A plurality of suspension members is coupled end to end to form a suspension to connect a second end of the column assembly to a mast. An intermediate connector is coupled to the intermediate suspension connection point and to at least two suspension members from among the plurality of suspension members. The suspension members are then tensioned to lift the second end of the column assembly.

DETAILED DESCRIPTION OF THE DRAWINGS AND THE PRESENTLY PREFERRED EMBODIMENTS

Figure 1:
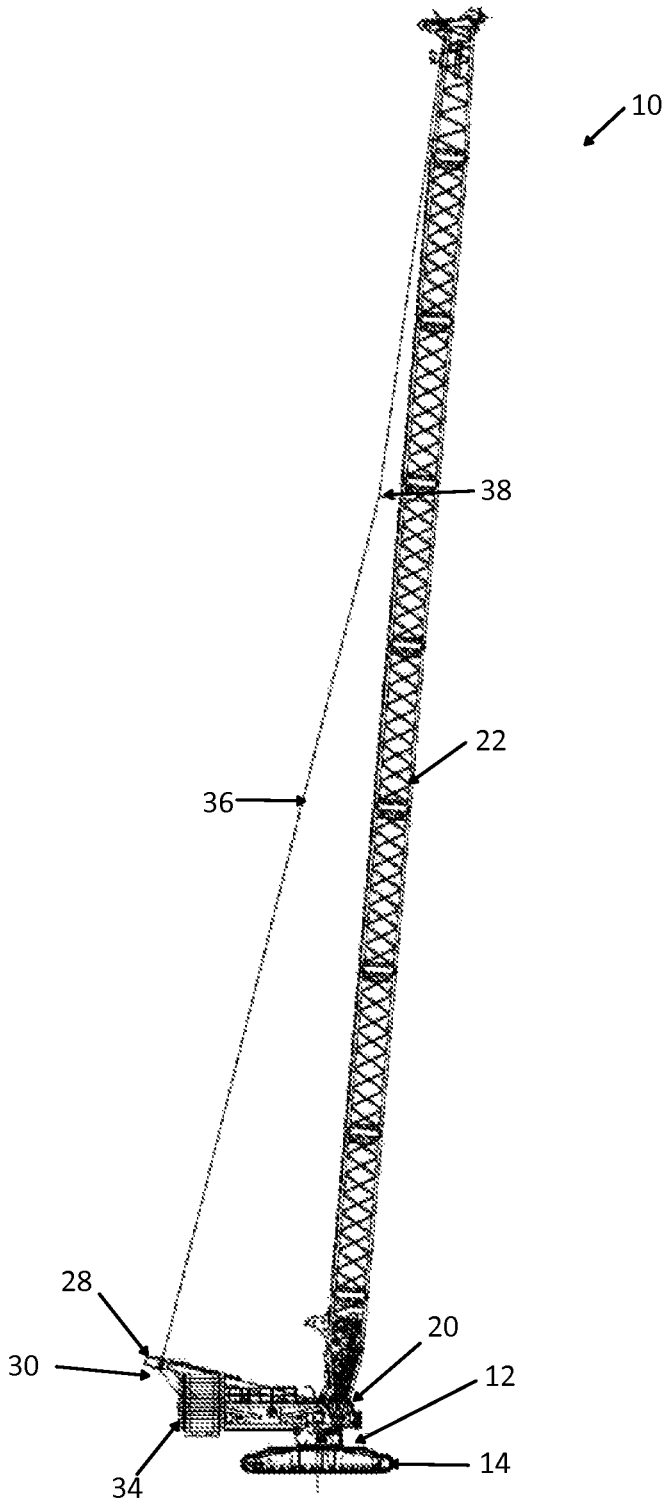
FIG. 1 is a side view of an embodiment of a mobile lift crane having a live mast.

The present invention will now be further described. In the following passages, different aspects of the invention are defined in more detail. Each aspect so defined may be combined with any other aspect or aspects unless clearly indicated to the contrary. In particular, any feature indicated as being preferred or advantageous may be combined with any other feature or features indicated as being preferred or advantageous.

The following terms used in the specification and claims have a meaning defined as follows.

The term "crane suspension assembly section" refers to sections that are connected together to form a suspension assembly for a crane. Examples of crane suspension assembly sections include a) sections, sometimes called strap sections, of the backstay between the boom top and the equalizer or live mast; b) sections of the backstay between a boom butt and a jib strut; c) sections of the backstay between a jib strut and a jib top, and d) counterweight strap sections between a mast top and a counterweight. Besides strap sections, which are traditionally elongated rigid metal members with a head on each end with a hole there through, sometimes wire rope pendants, carbon fiber tension members, and synthetic fiber members are used to create the longitudinal part of the crane suspension assembly, and are therefore crane suspension assembly sections. The sections may be made of multiple parallel elongated members. The term "crane suspension assembly section" also includes the equalizer and the boom top, since these are parts of the boom suspension assembly and are connected to boom backstay straps. "Crane suspension assembly section" also includes other members attached to strap sections, such as the boom butt, the mast top, the jib top, jib strut tops and live mast top, and intermediate suspension members.

The term "pin" refers to a generally cylindrical member that allows pivotal rotation between two or more structures that have a hole through them and are connected together by the pin fitting through the holes. A pin may include a head or retainer, such as a cotter pin, on one or both ends to prevent the pin from sliding longitudinally through the holes. While most pins used in the present invention will have smooth shafts, a bolt with a threaded shaft may be used as a pin in some instances, and in such usages is therefore within the meaning of the term "pin."

The term "connector plate" refers to a structure used to hold an elongated section of the crane suspension assembly to other sections of the assembly. Typically connectors have two holes through them so that they can be attached, with a pin through each hole, between two adjoining straps in the crane suspension assembly. A connector may have only one link plate. More typically the connector is made of multiple link plates so that it can sandwich the head of the strap between the link plates and thus transfer tension loads equally through the two link plates without inducing bending moments through the connector/strap section joint. When the straps to which the connectors are attached are made of multiple parallel elongated members, the connectors will often include a number of link plates one greater than the number of elongated members. For example, when the sections of the crane suspension system are made of two elongated members, the connector will be made with three link plates.

The term "tab" refers to an extension of material extending from a structure. A tab may be a separate component that is joined to the structure through commonly available techniques such as fasteners, welding, gluing or otherwise bonding. A "tab pair" refers to a pair of tabs that are used for a common purpose. For example, a tab pair may receive a component in a space between pair of tabs and both of the tabs may be used to secure the component.

While the invention will have applicability to many types of cranes, it will be described in connection with a mobile lift crane 10, shown in an operational configuration with a live mast in FIG. 1 and in an operational configuration with a fixed mast in FIG. 2. The mobile lift crane 10 includes lower works, also referred to as a carbody 12, and moveable ground engaging members in the form of crawlers 14. Of course additional crawlers than those shown can be used, as well as other types of ground engaging members, such as tires.

A rotating bed 20 is mounted to the carbody 12 with a slewing ring, such that the rotating bed 20 can swing about an axis with respect to the ground engaging members 14. The rotating bed 20 supports a boom 22 pivotally mounted on a front portion of the rotating bed 20; a live mast 28 mounted at its first end on the rotating bed 20, boom hoist rigging 30 connected to the live mast 28 adjacent a second end of the live mast 28; and a moveable counterweight unit 34. The counterweight unit 34 may be in the form of multiple stacks of individual counterweight members on a support member.

Boom hoist rigging 30 (described in more detail below) between the top of the live mast 28 and the rotating bed is used to control the angle of the live mast 28. A suspension assembly 36 between the top of the live mast 28 and the boom 22 supports the boom 22. A load hoist line (not shown) is trained over a pulley on the boom 22, supporting a hook (not shown) at a first end. At a second end, the load hoist line is wound on a first main load hoist drum connected to the rotating bed 20. The rotating bed 20 includes other elements commonly found on a mobile lift crane 10, such as an operator's cab and a hoist drum for the boom hoist rigging 30.

The boom hoist rigging 30 includes a boom hoist line in the form of wire rope wound on a boom hoist drum, and reeved through sheaves on the live mast 28. The live mast 28 is connected to the rotating bed 20 though the boom hoist rigging 30 and to the boom 22 through a suspension assembly 36. This arrangement allows rotation of the boom hoist drum to change the amount of boom hoist line between the live mast 28 and the rotating bed 20 changing the mast angle and thereby changing the boom angle through the suspension assembly 36.

As discussed above, the boom 22 is made by connecting multiple boom sections together and the boom 22 is supported during crane operation by the suspension assembly 36 made from boom strap sections. The top end of the suspension assembly 36 is connected to the top end of the boom 22 and an intermediate location of the suspension assembly 36 is connected to an intermediate location of the boom 22 through a pendant 38. The boom 22 may connect to the suspension assembly 36 through multiple pendants 38 at different locations on the boom 22.

Figure 2:
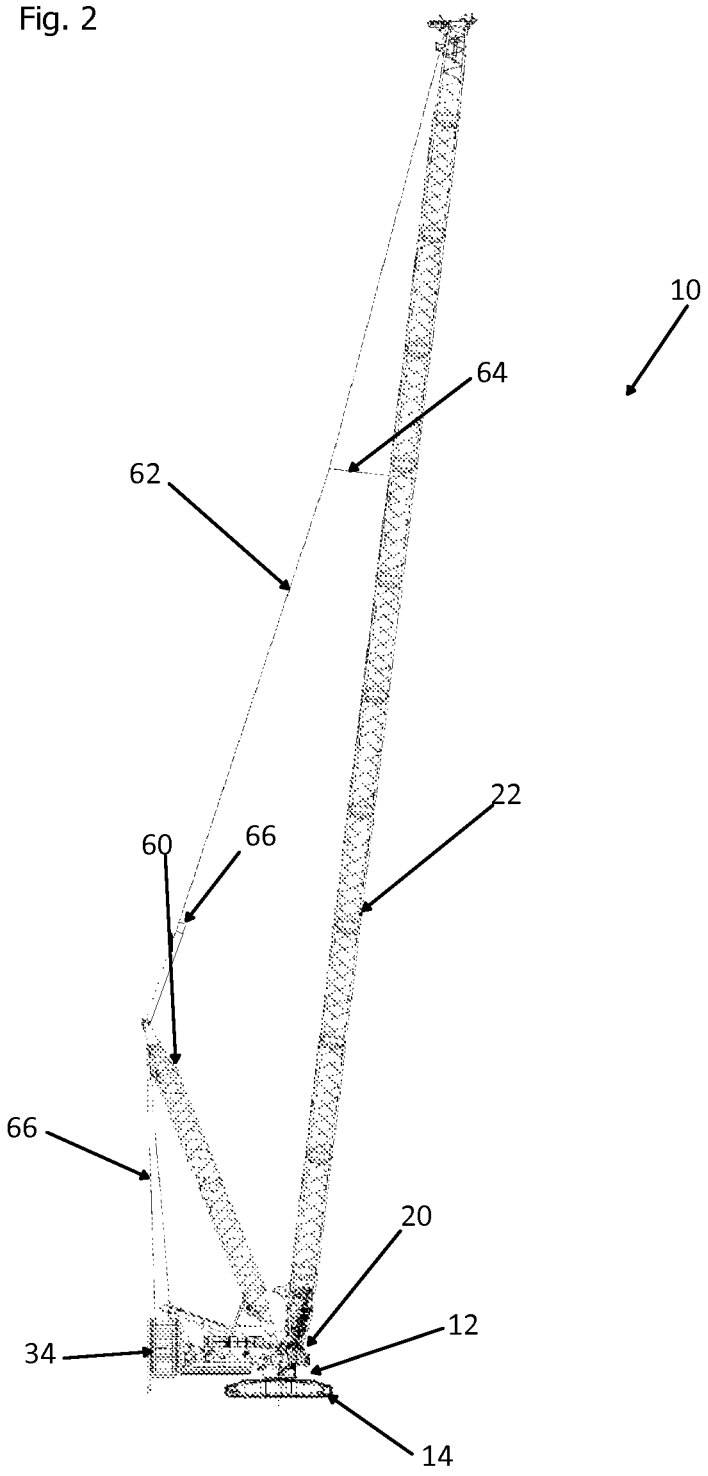
FIG. 2 is a side view of an embodiment of a mobile lift crane having a fixed mast.

FIG. 2 illustrates the mobile lift crane of FIG. 1 having a fixed mast 60 in addition to the live mast 28. The fixed mast 60 is connected to the boom 22 through suspension assembly 62. The suspensions assembly 62 is connected to the boom 22 at the hoist end and at an intermediate location through a pendant 64. The fixed mast 60 has a boom hoist line reeved between the fixed mast 60 and an equalizer 66 coupled to the suspension assembly 62 configured to adjust the distance between the fixed mast 60 and the hoist end of the boom 22 thereby adjusting the boom angle. The suspension assembly 62 is made up of the boom strap sections as described previously.

Figure 3:
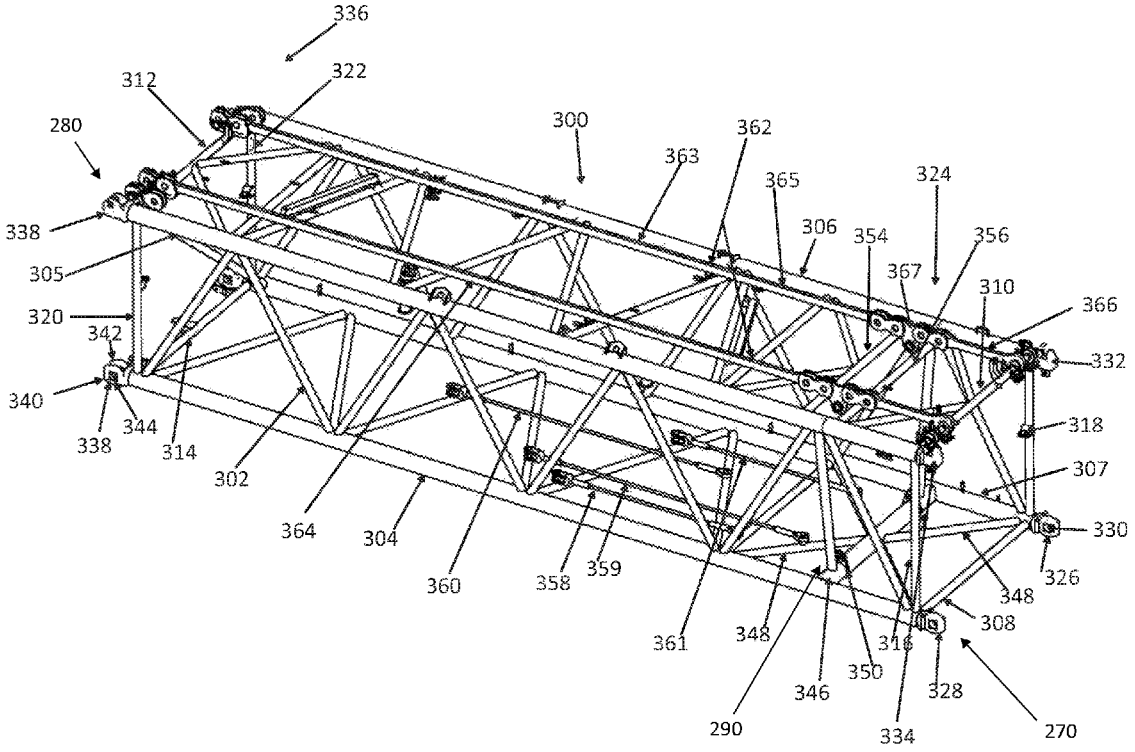
FIG. 3 is a perspective view of a boom insert suitable for use in the embodiments of the mobile lift cranes of FIGS. 1 and 2.

FIG. 3 illustrates an embodiment of an intermediate suspension connection column segment in the form of a boom insert 300. An intermediate suspension connection column segment may be used in other column structures such as jibs and masts and embodiments are not limited to booms. A column may be formed of multiple intermediate suspension connection column segments allowing the suspension assembly to connect to the column in multiple locations.

The boom insert 300 is made up of a lattice of structural elements 302 coupled to four longitudinal chords 304, 305, 306, 307. Other numbers of chords and different types of construction of an intermediate suspension connection column segment are possible and the embodiment of FIG. 3 is only given as an example. The four chords 304, 305, 306, 307 are arranged in a rectangular pattern with an axis of each chord 304, 305, 306, 307 arranged on a vertex of the rectangular pattern. The chords 304, 305, 306, 307 are parallel to one another along their axes such that together they form a square column. The structural elements 302 are arranged diagonally along the sides of the boom insert 300 such as between chords 304 and 305, chords 305 and 306, chords 306 and 307, and chords 307 and 304. At each end of the boom insert 300 horizontal structural elements 308, 310, 312, 314 and vertical structural elements 316, 318, 320, 322 are arranged between the rods to form a rectangular end of the boom insert 300.

A first end 324 of the boom insert 300 has a first connection 270 that includes a first tab 326 and a second tab 328 extending from the lower chords 304, 307 of the boom insert 300. Each tab 326, 328 has a horizontal aperture 330 sized and shaped to receive a pin. The first connection 270 also includes a first hook 332 and a second hook 334 extend from the upper chords 305, 306 of the first end 324 of the boom insert 300. The first hook 332 and the second hook 334 open upward and are sized and shaped to receive a pin.

A second end 336 of the boom insert 300 opposite the first end 324 has a second connection 290, such as four tab pairs 338, with each tab pair 338 extending longitudinally from a chord 304, 305, 306, 307. The tab pairs 338 each have a first tab 340 and a second tab 342 spaced apart by a distance slightly greater than a width of the tabs 326, 328 on the first end 324. The tab pairs 338 each have an aperture 344 sized and shaped to receive a pin.

A lower cross member 346 is disposed between the first end 324 of the boom insert 300 and the second end 336 of the boom insert 300. The lower cross member 346 extends from a first lower chord 304 horizontally to a second lower chord 307. The lower cross member 346 may have additional structural supports 348 tying the lower cross member 346 into the boom insert 300. An intermediate suspension connection 290 may include a first connector and a second connector disposed on an upper side of the lower cross member 346. In the embodiment of FIG. 3, the first connector and the second connector are tabs 350, each having an aperture there through. The aperture provides a location for a pendant to attach to the lower cross member 346.

Figure 11:
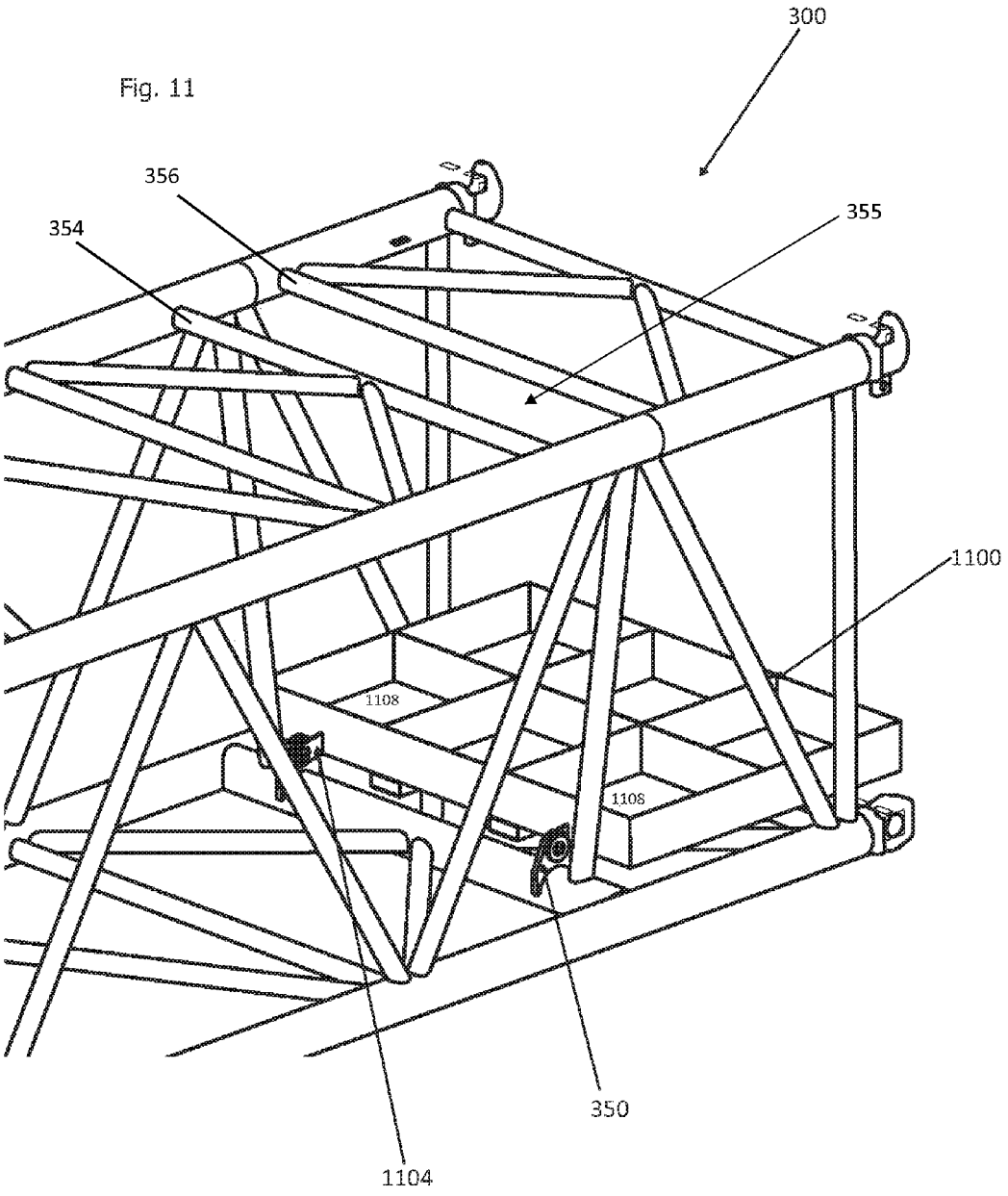
FIG. 11 illustrates the boom insert of FIG. 3 with a box for storing pendants in the boom insert.

Two upper cross members 354, 356 are disposed on the upper chords 305, 306 above the lower cross member 346. As best illustrated in FIG. 11, the upper cross members 354, 356 have a longitudinal spacing, or a space 355, sufficient to allow a pendant to pass between them. The two upper cross members 354, 356 may have additional structural members tying them into the boom insert 300.

Pendant elements 358, 359, 360, 361 may be stored within the lattice structure of the boom insert 300. A first pair of pendants 358, 361 has a first length for operating at a first boom length. A second pair of pendants 359, 361 has a second length for operating at a second boom length. Additionally pairs of pendants are possible for additional boom lengths. The pairs of pendants may be secured within the boom insert 300 through conventional means such as clamps, straps, and fasteners.

FIG. 11 illustrates the boom insert 300 of FIG. 3 with a box 1100 for storing pendants during transport of the boom insert 300. The box 1100 has two tabs 1104 extending from a side of the box 1100. The tabs 1104 have a distance between their outer faces that is less than the distance between the tabs 350 on the lower cross member 346 such that the tabs 1104 of the box 1100 fit between the tabs 350 of the lower cross member 346. A pin may be inserted into the aperture of the lower cross member tabs 350 and into an aperture of the tabs 1104 of the box 1100, thereby securing the box 1100 to the boom insert 350. The box 1100 is divided into a series of compartments 1108 for storing a pendant. The pendants may be flexible such that they may be coiled and placed in a compartment 1108 of the box 1100. The box 1100 shown in FIG. 11 has 6 compartments 1108, and each compartment 1108 may house a pair of pendants for a total of 6 different possible lengths. Or in some embodiments each compartment 1108 may hold a single pendant such that three pairs of pendants are stored in the box 1100. Other quantities of compartments 1108 are possible and the storage of the pendants may be mixed, with some compartments 1108 holding a single pendant and other holding more than one pendant. A cover may be secured over the box 1100 to close the compartments 1108 holding the pendants. During use of the boom insert 300, the box 1100 may be removed from the boom insert 300.

A suspension assembly section 362 may be stored on the boom insert 300. The suspension assembly section 362 includes a first strap assembly 363 and a second strap assembly 364. Each of the strap assemblies 363, 364 includes a first strap segment 365, a second strap segment 366, and a link or three-way connector 367. A first end of the first strap segment 365 is coupled to the link or three-way connector 367 and a first end of the second strap segment 366 is coupled to the three-way connector 367. A second end of the first strap segment 365 has a connector for connecting to an adjacent component. A second end of the second strap segment 366 has a connector for connecting to an adjacent component. The second ends of the strap segments 365, 366 may be configured to connect directly to an adjacent strap, or they may be configured to connect to an adjacent strap through a connector plate. The strap assemblies 363, 364 may be secured to the boom segment 300 for transportation and storage using commonly available techniques such as clamps, straps, and fasteners.

Figure 5:
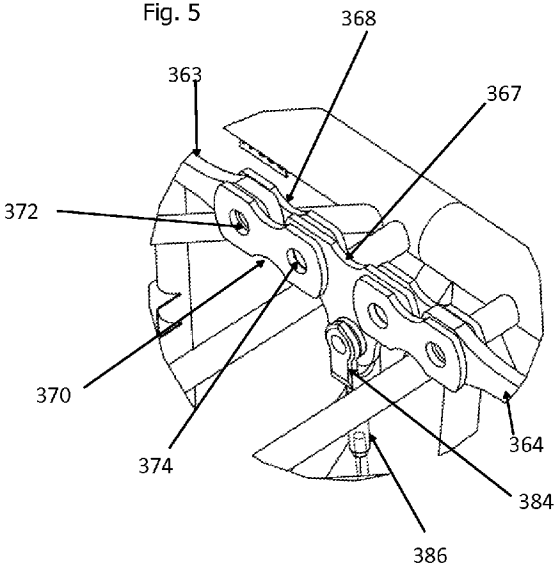
FIG. 5 is a view of the top end of the pendant being connected to the suspension assembly segment of FIG. 4.

FIG. 5 provides a detailed view of the strap segments 363, 364 being connected to the three-way connector 367. The first end of each strap segment 363, 364 has an aperture sized and shaped to receive a pin. The three-way connector 367 has a thickness that is similar to a thickness of the strap segments 363, 364. Three apertures are disposed in the three-way connector 367 with each aperture sized and shaped to receive a pin. A pair of connector plates 368, 370 is disposed about the first end of a strap segment 363 with an aperture 372 of the connector plates 368, 370 aligning with the aperture of the strap segment 363. A pin is inserted through the aperture 372 of the connector plates 368, 370 and the aperture of the first end of the strap segment 363, coupling the strap segment 363 to the connector plates 368, 370. The connector plates 368, 370 are positioned on each side of the three-way connector 367 with a second aperture 374 of the connector plates aligned with an aperture of the three-way connector 367. A pin is inserted through the aperture 374 of the connector plates 368, 370 and through the aperture of the three-way connector 367, coupling the connector plates 368, 370 to the three-way connector 367. The process is repeated for the remaining strap segment 364 such that two strap segments 363, 364 are coupled to the three-way connector 367. With the strap segments 363, 364 coupled to the three-way connector 367, the strap assembly 363 is ready to be used in a suspension assembly such as suspension assembly 36 and suspension assembly 62.

Figure 4:
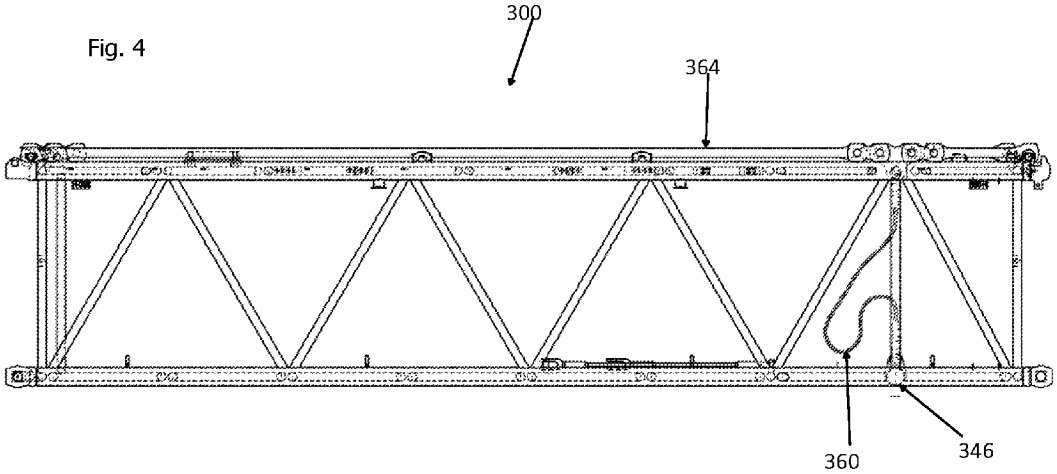
FIG. 4 is a side view of the boom insert of FIG. 3, showing a pendant connecting the boom insert and a suspension assembly segment.
Figure 6:
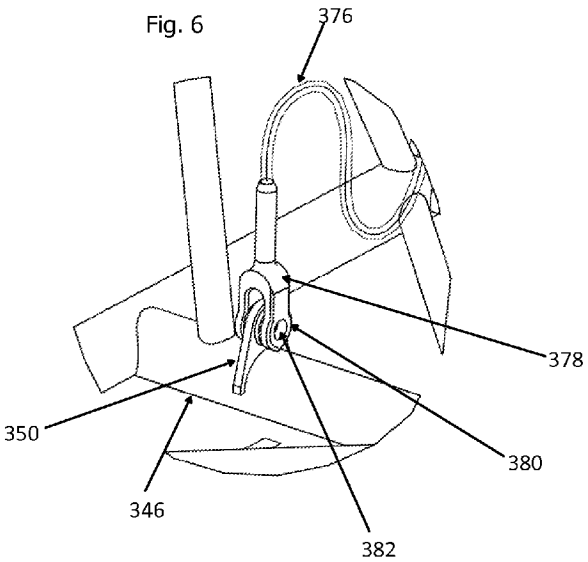
FIG. 6 is a detailed perspective view of the bottom end of the pendant being connected to the boom insert of FIG. 3.

FIG. 4 illustrates a side view of an embodiment of the boom insert 300 of FIG. 3 having a pendant 360 coupled to the lower cross member 346 and to a strap assembly 364. FIG. 5 illustrates a detailed view of connection of the pendant 360 to the three-way connector 367, while FIG. 6 illustrates a detailed view of the pendant 360 coupled to the tab 350 of the lower cross member 346. In this embodiment the pendant 360 is a flexible rope tensioning member 376. The flexible rope tensioning member 376 may be a wire rope, a carbon fiber rope, or other synthetic fiber rope. The flexible rope tensioning member 376 has a connector 378 at each end with a parallel tab pair 380 having an aperture 382.

The parallel tab pair 380 is spaced apart by a distance greater than a width of the tab 350 on the lower cross member 346 and the width of the three-way connector 367.

As shown in FIG. 6, the connector 378 at the lower end of the pendant 360 is coupled to the lower cross member 346 by placing the tab pair 380 over the tab 350 of the lower cross member 346 such that the aperture of the tab pair 380 aligns with the aperture of the tab 350 of the lower cross member 346. A pin is then inserted through the apertures coupling the pendant 360 to the lower cross member 346.

As shown in FIG. 5, the upper end of the pendant 360 is coupled to the three-way connector 367 by placing a tab pair 384 of the upper connector 386 over the three-way connector 367 aligning the aperture of the tab pair 384 with an available aperture of the three-way connector 367. A pin is then inserted though the apertures coupling the pendant 360 to the three-way connector 367.

Figure 7:
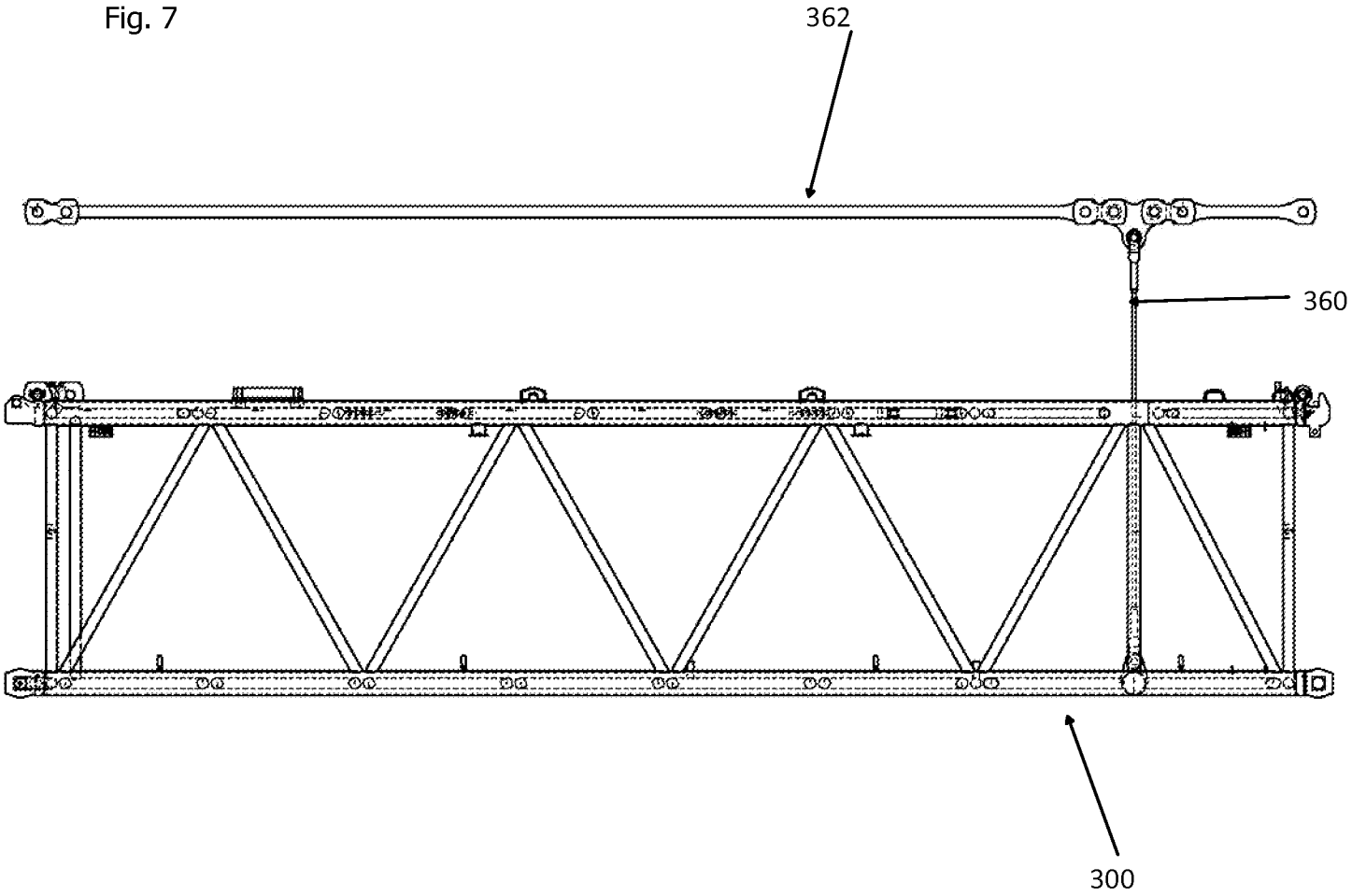
FIG. 7 is a side view of the boom insert of FIG. 3 and suspension assembly segment with the suspension assembly segment being raised.

FIG. 7 illustrates the boom insert 300 of FIG. 4 with the suspension assembly section 362 being coupled to the boom insert 300 through pendant 360. The suspension assembly section 362 is shown elevated above the boom insert 300 with the pendant 360 being stretched between the suspension assembly section 362 and the boom insert 300. The suspension assembly section 362 would be lifted from the boom insert 300 as shown in FIG. 7 when a mobile crane lifts the boom. The suspension assembly section 362 lifts the boom insert 300 through the pendant 360 as the mobile crane lifts the boom. Different lengths of pendants may be used to adjust the height the suspension assembly section 362 may rise above the boom insert 300 before lifting the boom insert 300. Typically when the boom insert 300 is used near the hoist end of the boom, a shorter pendant is used compared to the boom insert 300 being used farther from the hoist end of the boom.

Figure 8:
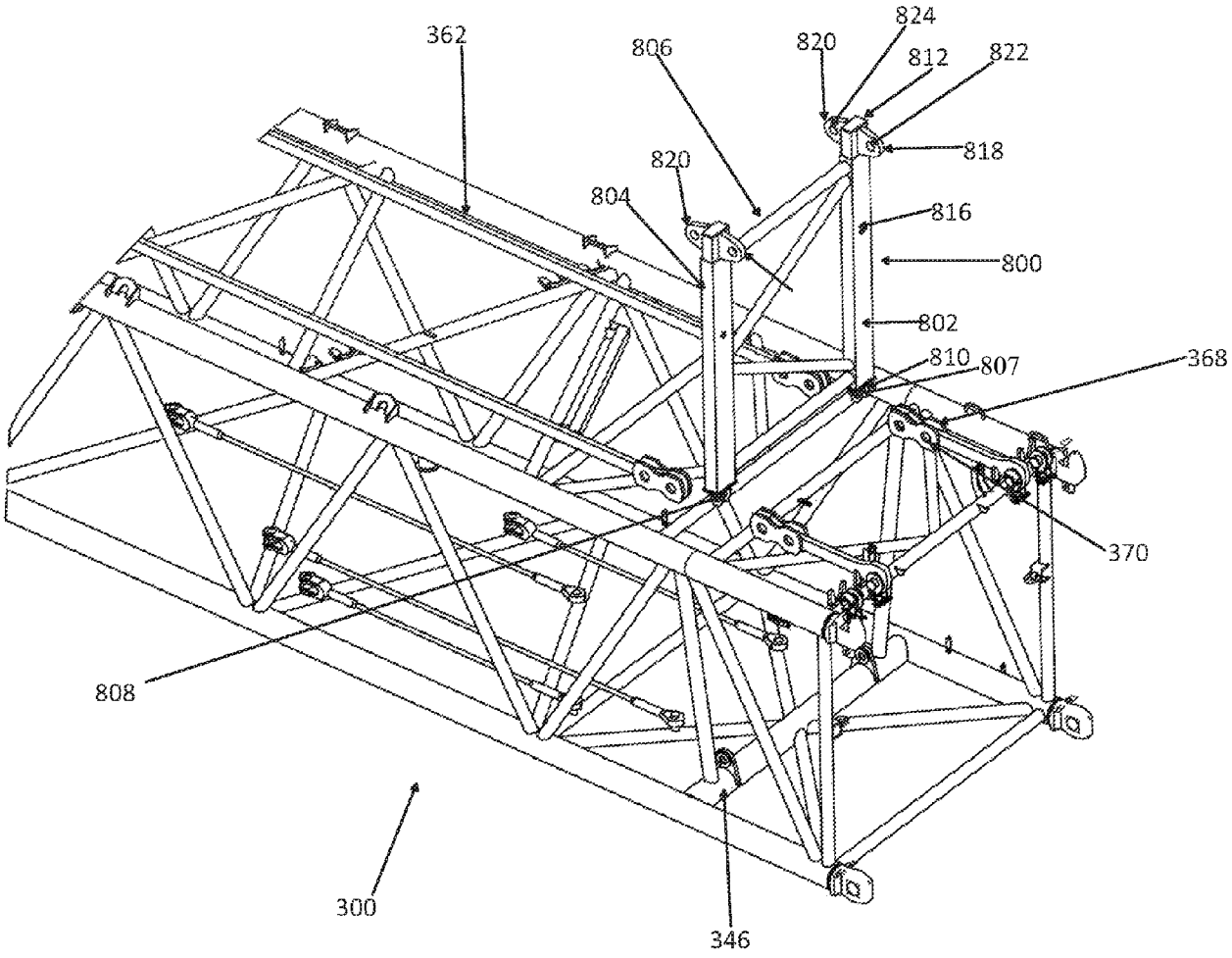
FIG. 8 is a perspective view of the boom segment of FIG. 3 with an alternative pendant assembly.
Figure 9:
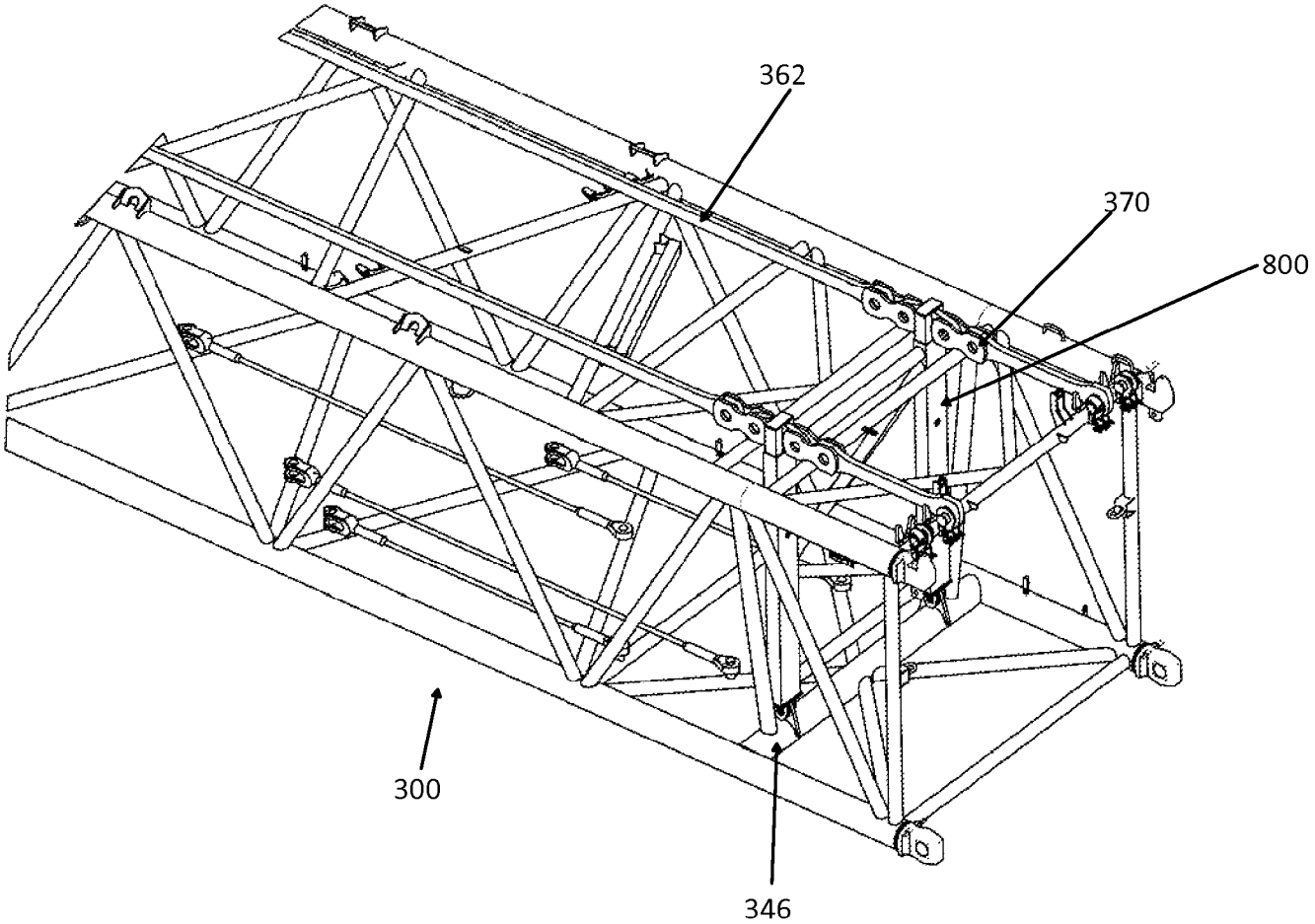
FIG. 9 is a perspective view of the boom insert of FIG. 8 showing the alternative pendant assembly being coupled to the boom insert and the suspension assembly segment.

FIG. 8 illustrates the boom insert 300 of FIG. 3 with an alternative pendant assembly 800. The pendant assembly 800 has two vertical posts 802, 804 coupled by cross bracing 806. A lower end of each vertical post 802, 804 has a connector 807 for coupling to the lower crossbar 346 of the boom insert 300. The connector 807 is a tab pair 808 spaced apart by at last the thickness of the tab 350 of the lower cross member 346. The tab pair 808 has an aperture 810 sized and shaped to receive a pin. As shown in FIG. 9, in use the tab pair 810 is placed over the tab 350 of the lower cross member 346 such that the aperture 810 of the tab pair 808 is aligned with the aperture of the tab 350 of the lower cross member 346. A pin is inserted through the apertures 810 to couple the pendant assembly 800 to the boom insert 300.

Each of the vertical posts 802, 804 has a longitudinal cavity disposed in an upper end of the post. The longitudinal cavity is sized and shaped to receive a post insert 812 in a slidable connection. A post insert 812 is disposed in the longitudinal cavity. A retention mechanism retains the post insert 812 within the longitudinal cavity. Thus the post insert 812 may move vertically within the longitudinal cavity, but the retention mechanism prevents the post insert 812 from leaving the longitudinal cavity completely. The retention mechanism may be a vertical slot 814 in the post insert 812 and a corresponding pin 816 extending from the vertical post 802 into the vertical slot 814. In other embodiments the retention mechanism may be an enlarged lower portion of the post insert 812 and a narrowed upper portion of the post cavity, a mechanical interference preventing the post insert 812 from escaping the post cavity, or any other retention mechanism.

The post insert 812 has an upper end having a fastener for coupling to a strap assembly. In some embodiments the upper end may have a tab pair that function as previously described with relation to the flexible pendant upper connector 384. In such embodiments the upper connector 384 would couple to the existing three-way connection 367. In other embodiments the upper end of the post insert 812 may have two tabs 818, 820 extending from the post insert 812 with each of the tabs 818, 820 having an aperture 822, 824 sized and shaped to receive a pin. In such embodiments the three-way connector is not necessary and the connection plates 368, 370 are connected directly to the pendant assembly 800 by inserting a pin through the aperture of the connection plates 368, 370 and the aperture 822, 824 of a tab 818, 820 on the post insert 812.

Figure 10:
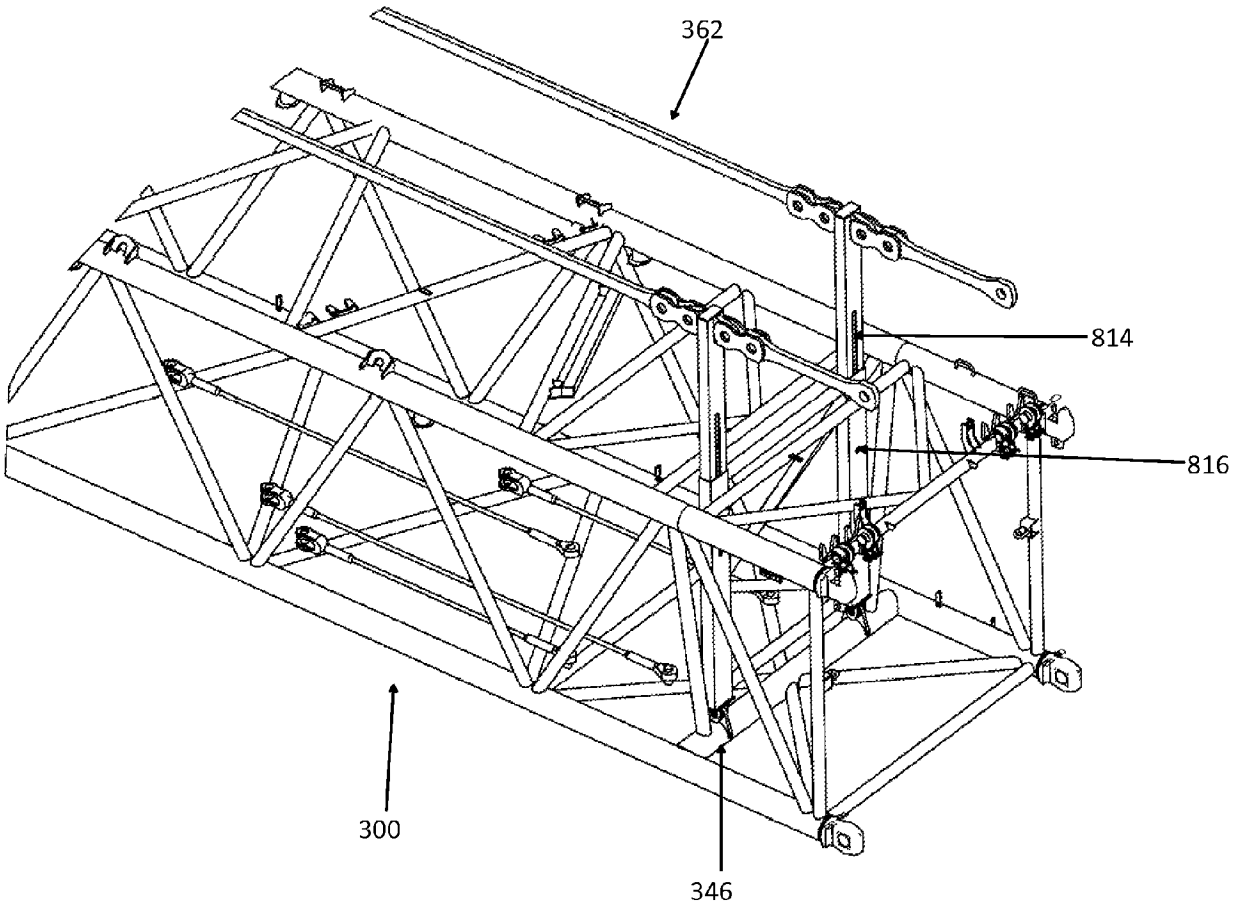
FIG. 10 is a perspective view of the alternative pendant assembly of FIG. 8 being extended with the suspension assembly segment being raised.

FIG. 10 illustrates the boom insert of FIG. 3 with the pendant assembly of FIGS. 8 and 9. The suspension assembly section 362 is shown elevated above the boom insert 300 with the pendant assembly 800 being extended between the suspension assembly section 362 and the boom insert 300. The suspension assembly section 362 would be lifted from the boom insert 300 as shown in FIG. 10 when a mobile crane lifts the boom. The suspension assembly section 362 lifts the boom insert 300 through the pendant assembly 800 as the mobile crane lifts the boom. Different lengths of pendants assemblies' may be used to adjust the height the suspension assembly section 362 may rise above the boom insert 300 before lifting the boom insert 300. In other embodiments, the retention mechanism may be adjustable to control the length that the post inserts 802, 804 may rise above the boom insert 300. For instance, when the retention mechanism is a slot 814 in the post insert 802, 804 and a pin 816 extending into the slot 814, the pin 816 may have different locations in which it may be inserted to adjust the height that the suspension assembly section 362 may raise.

Figure 12A:
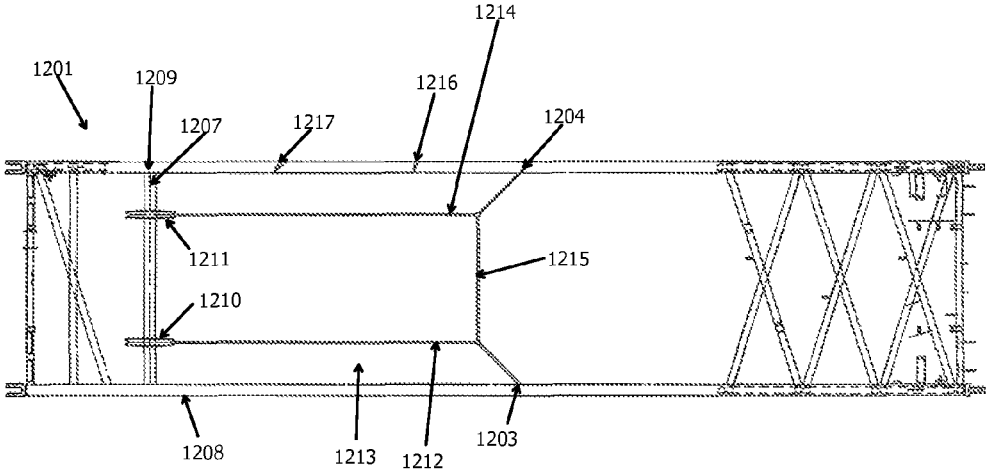
FIG. 12*a* is a top view of an alternative embodiment of an insert.
Figure 12B:
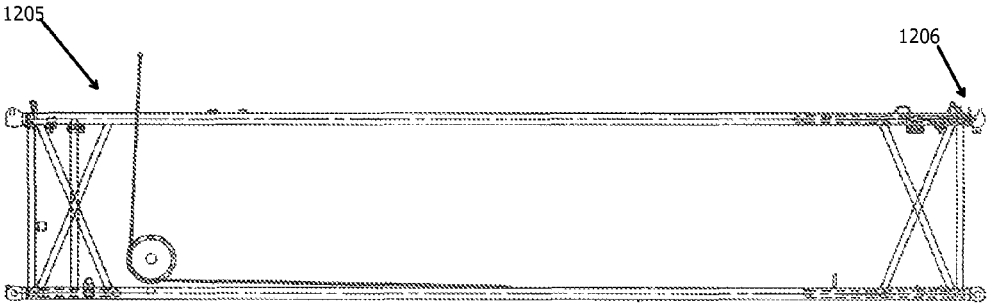
FIG. 12*b* is a side view of the insert of FIG. 12*a*.

FIGS. 12*a* and 12*b* illustrate another embodiment of an insert 1201 having intermediate suspension connection disposed between a first end 1205 and a second end 1206 of the insert 1201. The insert 1201 has an attachment mechanism disposed on each end 1205, 1206. The attachment mechanism includes tabs and apertures as described previously with respect to FIG. 3. Other connection types are possible such as hooks, bolts, clamps, and the like. The insert 1201 is similar in structure to the embodiment of FIG. 3 and like elements will not be repeated.

The insert 1201 has a cross member 1207 coupled to a first lower chord 1208 and a second lower chord 1209. The cross member 1207 has a first sheave 1210 and a second sheave 1211 mounted thereto. The first sheave 1210 and the second sheave 1211 rotate about the cross member 1207. A pendant assembly 1212 has a first flexible pendant 1213 and a second flexible pendant 1214 connected by a cross pendant 1215. The first pendant 1213 couples to the first lower chord 1208 at a first intermediate suspension connection 1203, and the second pendant 1214 couples to the first lower chord 1209 at a second intermediate suspension connection 1204. Each lower chord may have additional intermediate suspension connections such as intermediate suspension connection 1216 and intermediate suspension connection 1217. The first pendant 1213 and the second pendant 1214 are configured to couple to any of the intermediate suspension connections. By changing the intermediate suspension connection to which the pendants connect, the effective length of the pendant may be varied.

Figure 13A:
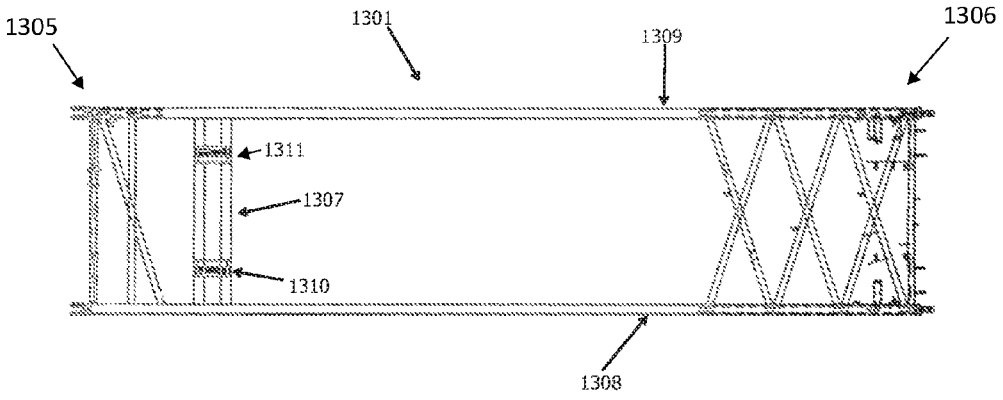
FIG. 13*a* is a top view of an alternative embodiment of an insert.
Figure 13B:
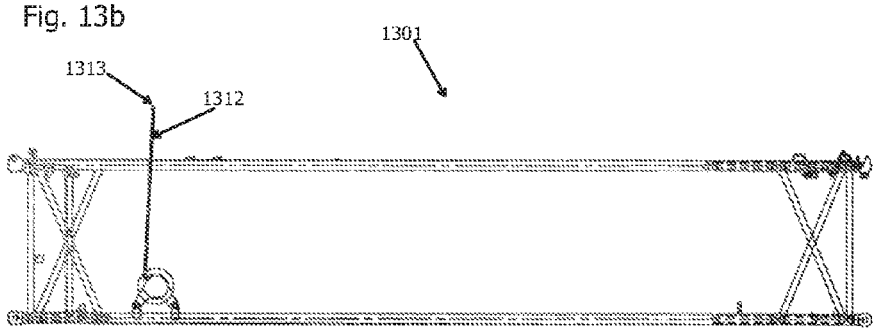
FIG. 13*b* is a side view of the insert of FIG. 13*a*.

FIGS. 13*a* and 13*b* depict another embodiment of an insert 1301 having an intermediate suspension connection in the form of a drum disposed between a first end 1305 and a second end 1306 of the insert 1301. The insert 1301 has an attachment mechanism disposed on each end 1305, 1306 for attachment to an adjoining insert. The attachment mechanism may include tabs and apertures as described previously with respect to FIG. 3. Other connection types are possible such as hooks, bolts, clamps, and the like. The insert 1301 is similar in structure to the embodiment of FIG. 3 and like elements will not be repeated.

The insert 1301 has a cross member assembly 1307 coupled to a first lower chord 1308 and a second lower chord 1309. The cross member assembly 1307 has a first drum 1310 and a second drum 1311. Each drum 1310, 1311 has an associated flexible pendant 1312 that wraps around the drum 1310, 1311 and is coupled to drum 1310, 1311. A free end 1313 of the flexible pendant 1312 extends away from the drum 1310, 1311 and is configured to connect to a suspension assembly. The drum 1310, 1311 may be rotated to adjust the length of the flexible pendant 1312 extending from the drum 1310, 1311. In some embodiments, the drum 1310, 1311 may be manually rotated and have a brake to hold the drum 1310, 1311 in place when the desired length of flexible pendant 1312 is extended. In other embodiments the drum 1310, 1311 may be a powered drum rotated by an electric actuator such as a motor, a hydraulic actuator such as a hydraulic drive, or a mechanical connection.

In some embodiment the powered drum may adjust the length of the flexible pendant 1312 automatically. For example, the flexible pendant 1312 may have a tension sensor that measures the tension in the flexible pendant 1312. The powered drum may adjust the length of the flexible pendant 1312 until the tension in the flexible pendant 1312 matches a set value. In another embodiment a stress in a chord of an insert may be measured and the length of the flexible pendant 1312 may be adjusted to maintain the stress within a predetermined window. Other types of sensors and changes to the flexible pendant 1312 length are possible and embodiments need not be limited to tension in the flexible pendant 1312 or stress in a cord.

Figure 14A:
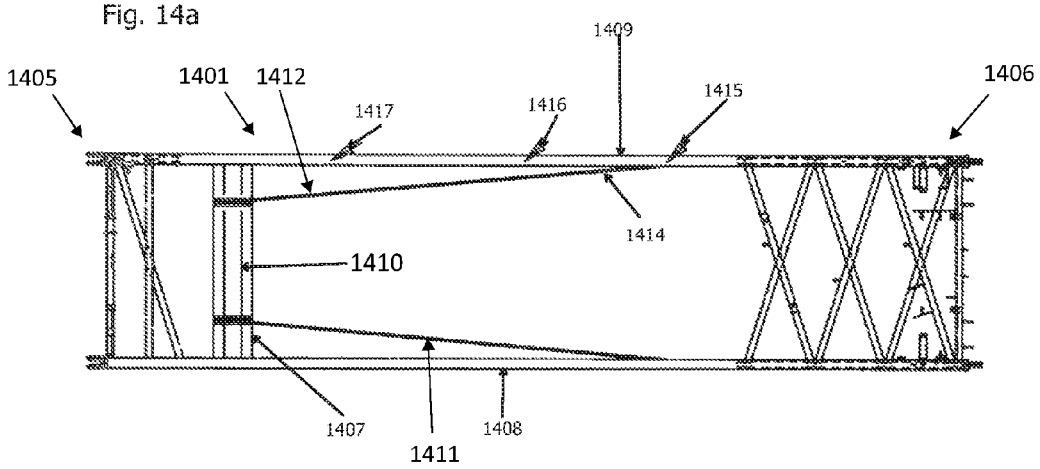
FIG. 14*a* is a top view of an alternative embodiment of an insert.
Figure 14B:
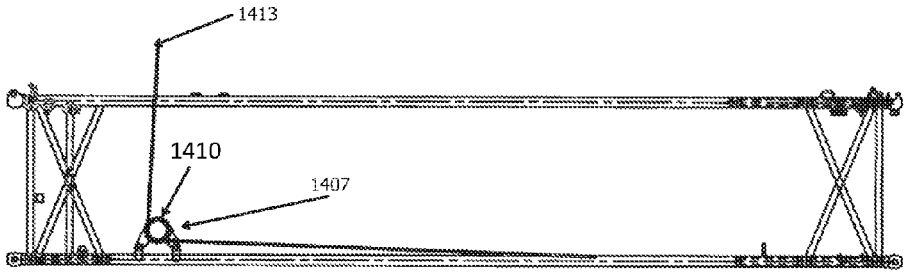
FIG. 14*b* is a side view of the insert of FIG. 14*a*.

FIGS. 14*a* and 14*b* depict another embodiment of an insert 1401 having an intermediate suspension connection disposed between a first end 1405 and a second end 1406 of the insert 1401. The insert 1401 has an attachment mechanism disposed on each end 1405, 1406 for attachment to an adjoining insert. The attachment mechanism may include tabs and apertures as described previously with respect to FIG. 3. Other connection types are possible such as hooks, bolts, clamps, and the like. The insert 1401 is similar in structure to the embodiment of FIG. 3 and like elements will not be repeated.

The insert 1401 has a cross member assembly 1407 coupled to a first lower chord 1408 and a second lower chord 1409. The cross member assembly 1407 has a cylindrical capstan 1410 having a first flexible pendant 1411 and a second flexible pendant 1412 wrapped about the cylindrical capstan 1410. The flexible pendants 1411, 1412 include a first free end 1413 of the flexible pendants 1411, 1412 that extends away from the capstan 1410 and has an end connection for connecting to a suspension assembly. A second free end 1414 of the flexible pendants 1411, 1412 extends away from the capstan along a lower side of the insert and is coupled to either the first lower chord 1408 or the second lower chord 1409. The lower chords 1408, 1408 may each have multiple connections 1415, 1416, 1417 at which the second free end 1414 of the flexible pendant 1411, 1412 may attach. By adjusting the position at which the second free end 1414 of the flexible pendant 1411, 1412 attaches to the lower chords 1408, 1409, the extended length of the first free end 1413 of the may be adjusted. Additionally, the length of the first free end 1413 of the flexible pendant 1411, 1412 may be adjusted by changing the number of wraps of the flexible pendant 1411, 1412 around the capstan 1410.

Figure 15A:
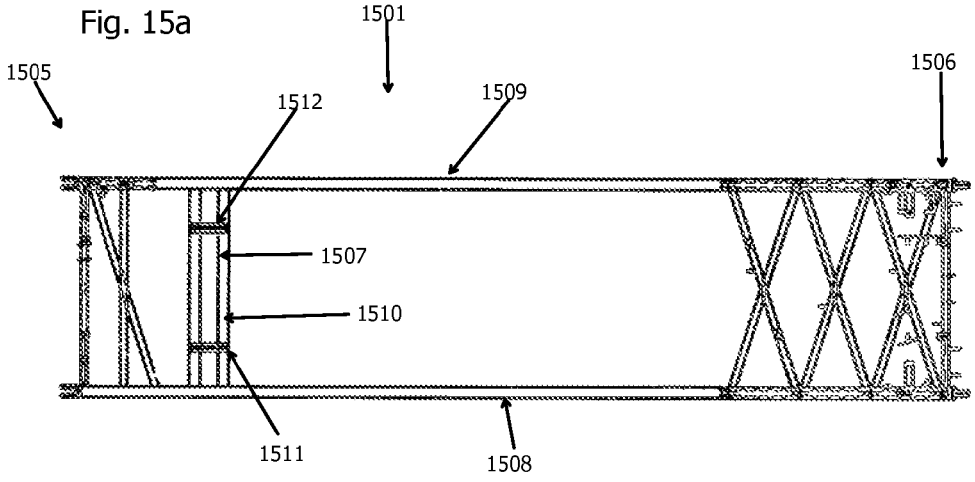
FIG. 15*a* is a top view of an alternative embodiment of an insert.
Figure 15B:
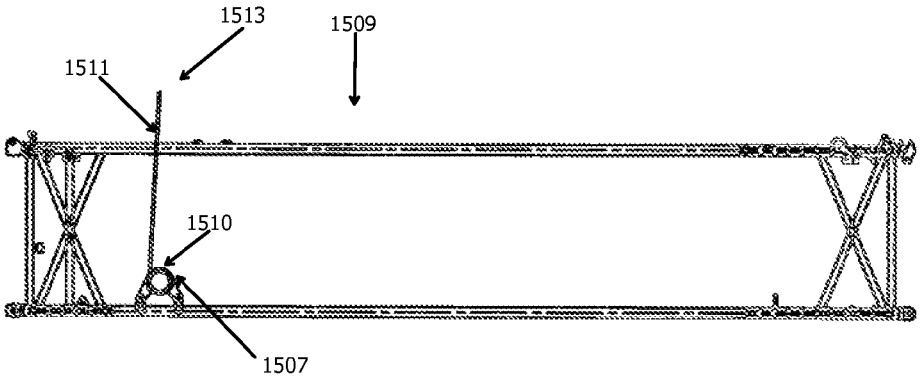
FIG. 15*b* is a side view of the insert of FIG. 15*a*.

FIGS. 15*a* and 15*b* depict another embodiment of an insert 1501 having an intermediate suspension connection disposed between a first end 1505 and a second end 1506 of the insert 1501. The insert 1501 has an attachment mechanism disposed on each end 1505, 1506 for attachment to an adjoining insert. The attachment mechanism may include tabs and apertures as described previously with respect to FIG. 3. Other connection types are possible such as hooks, bolts, clamps, and the like. The insert 1501 is similar in structure to the embodiment of FIG. 3 and like elements will not be repeated.

The insert 1501 has a cross member assembly 1507 coupled to a first lower chord 1508 and a second lower chord 1509. The cross member assembly 1507 has a cylindrical capstan 1510 having a first flexible pendant 1511 and a second flexible pendant 1512 wrapped about the cylindrical capstan 1510. A free end 1513 of the flexible pendants 1511, 1512 extends away from the capstan 1510 and has an end connection for connecting to a suspension assembly. An opposite end of the flexible pendants 1511, 1512 is coupled to the capstan 1510. The length of the free end 1513 of the pendants 1511, 1512 may be adjusted by changing the number of wraps the flexible pendants 1511, 1512 wrap around the capstan 1510.

Figure 16:
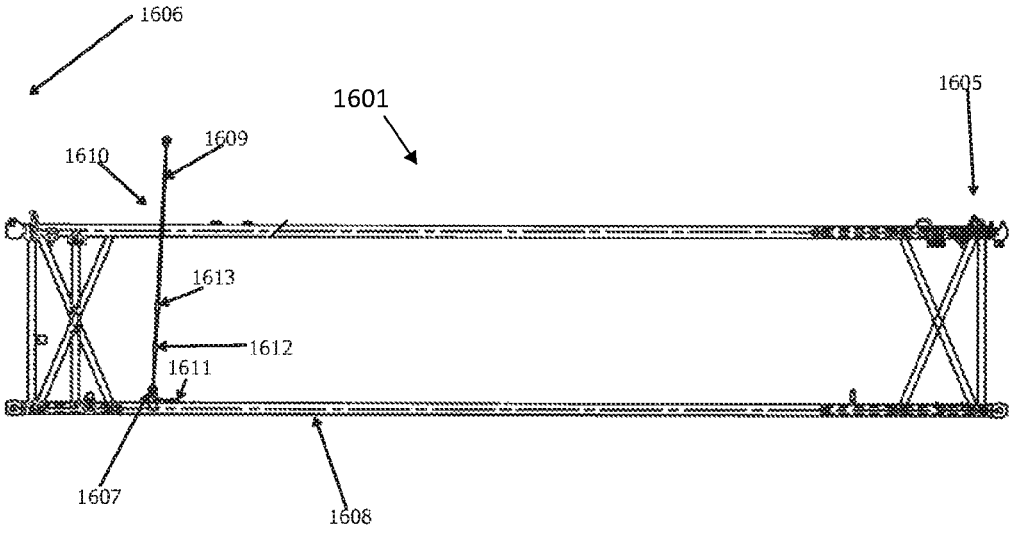
FIG. 16 is a side view of an alternative embodiment of an insert.

FIG. 16 depicts another embodiment of an insert 1601 having an intermediate suspension connection disposed between a first end 1605 and a second end 1606 of the insert 1601. The insert 1601 has an attachment mechanism disposed on each end 1605, 1606 for attachment to an adjoining insert. The attachment mechanism may include tabs and apertures as described previously with respect to FIG. 3. Other connection types are possible such as hooks, bolts, clamps, and the like. The insert 1601 is similar in structure to the embodiment of FIG. 3 and like elements will not be repeated.

The insert 1601 has a cross member 1607 coupled to a first lower chord 1608 and a second lower chord 1650. Flexible pendants 1609, 1651 connect to the cross member 1607 and have free end 1610, 1652 that extends away from the cross member 1607 towards a suspension assembly. The flexible pendants 1609, 1651 have a plurality of fittings 1611, 1612, 1613, or areas of enlarged cross section sometimes referred to as a button. The fittings 1611, 1612, 1613 secure within a connection on the cross member 1607 as will be described below. The fittings 1611, 1612, 1613 are set at a fixed length and depending on the particular fitting that is used to secure the flexible pendants 1609, 1651 the effective length of the flexible pendants 1609, 1651 may be adjusted.

Figure 17:
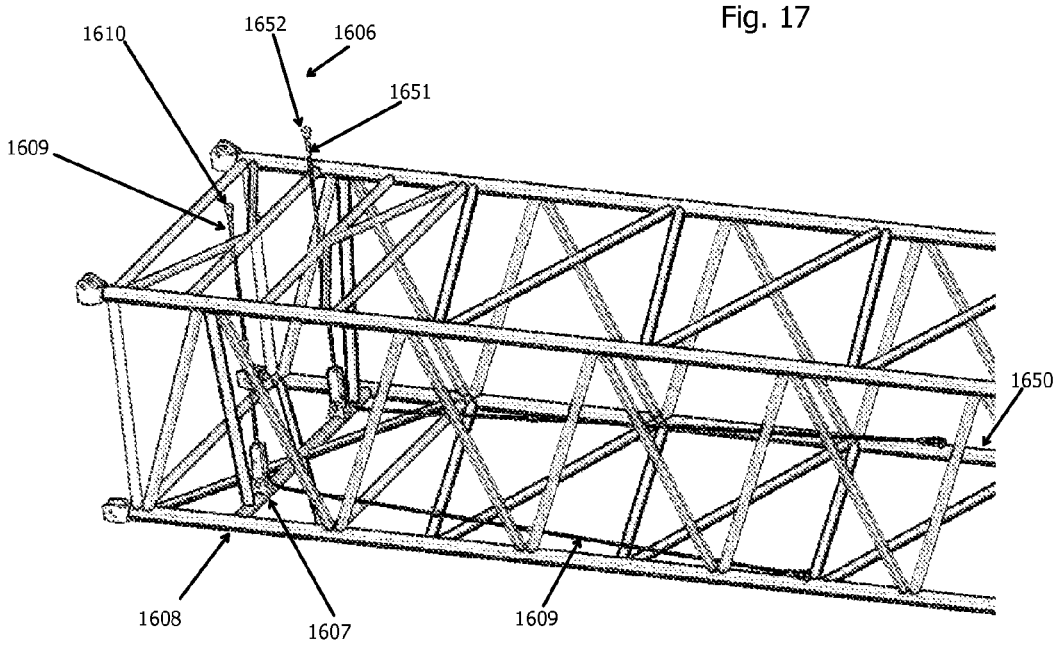
FIG. 17 is a perspective view an end of the inset of FIG. 16.
Figure 18:
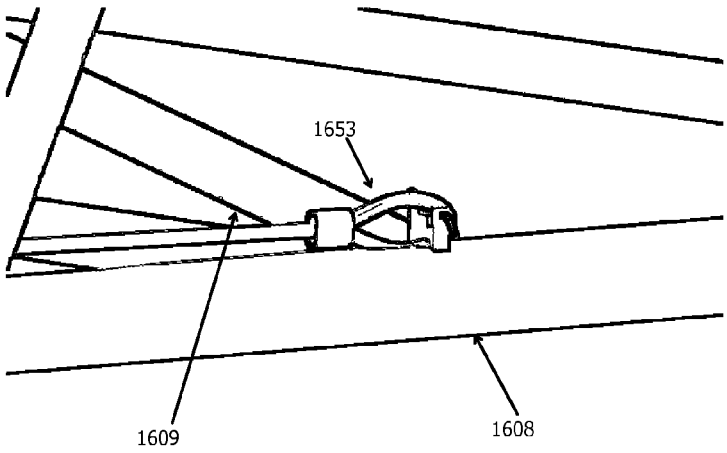
FIG. 18 is a detailed view of the embodiment of FIG. 16 showing an end connection of a flexible pendant.

FIG. 17 is a perspective view of the second end 1606 of the insert 1601 of FIG. 16 showing the flexible pendants 1609, 1651. FIG. 18 is a detailed view of a flexible pendant 1609 positioned along the first chord 1608 and having a free end 1653 attached to the first chord 1608. The first chord 1608 may have multiple locations in which the free end 1653 may attach depending on the length of the flexible pendant 1609.

Figure 19:
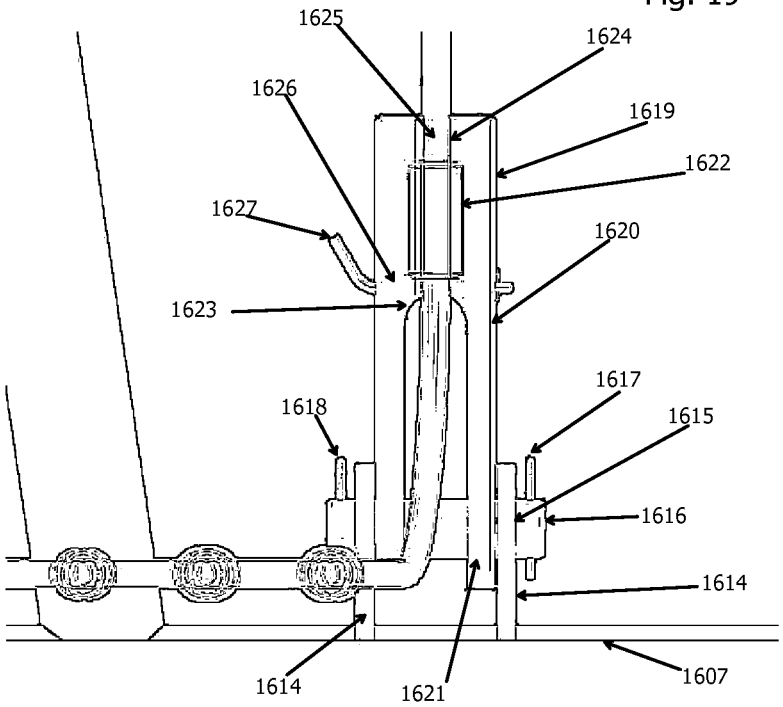
FIG. 19 is a detailed view of the embodiment of FIG. 16 showing a connection of a flexible pendant.
Figure 20:
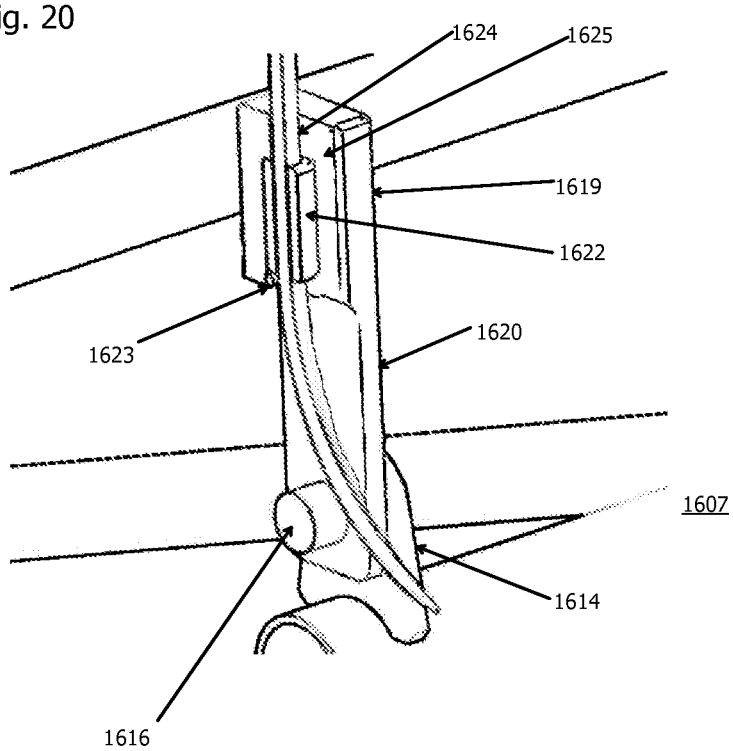
FIG. 20 is a detailed view of the embodiment of FIG. 16 showing a detailed cross section of a connection of a flexible pendant.

FIG. 19 is a detailed view of the connection of FIG. 16 and its interaction with the fittings 1611, 1612, 1613 of the flexible pendant 1609. FIG. 20 is a detailed cross section of the connection of FIG. 16. The connection has tab pair 1614 that is coupled to the cross member 1607 through a conventional means such as welding. The tab pair 1614 has an aperture 1615 through which a pin 1616 may be inserted. The pin 1616 has a length greater than an external width of the tab pair 1614 such that the pin 1616 extends from both sides of the tab pair 1614 when it is inserted. A first cotter pin 1617 and a second cotter pin 1618 may secure the pin 1616 within the aperture 1615 of the tab pair 1614. In other embodiments the pin 1616 may have a threaded end and be threaded within the aperture 1615 or threaded into a nut outside of the tab pair 1614.

A sleeve 1619 has two legs 1620 with apertures 1621 that are similar to the aperture 1615 of the tab pair 1614. In use, the legs 1620 are placed in the space between each tab of the tab pair 1614 such that the apertures 1615 of the tab pair 1614 and the apertures 1621 of the legs 1620 are aligned. The pin 1616 is then inserted through the apertures 1615, 1621 securing the sleeve 1619 to the tab pairs 1614. In other embodiments the legs 1620 may have an internal spacing wider than the outer width of the tab pair 1614, or a single tab, such that in use the tab pair 1614 fits between the legs 1620.

The sleeve 1619 of FIG. 20 is shown cut away so that the interaction of the fitting 1622 and the sleeve 1619 can be seen. The sleeve 1619 has a cavity 1623 having an internal diameter that is larger than an external diameter of the fitting 1622. At one end of the cavity 1623, there is a portion 1624 having a reduced diameter that is larger than an external diameter of the flexible pendant 1609, but less than the outer diameter of the fitting 1622. A slot 1625 that is wider than the flexible pendant 1609, but narrower than the fitting 1622 is cut along one side of the sleeve 1619. Thus a portion of the flexible pendant 1609 between fittings may be inserted into the cavity 1623 through the slot 1625. The flexible pendant 1609 may then be moved with the fitting 1622 sliding into the cavity 1623. The fitting 1622 may slide within the cavity 1623 until the fitting 1622 reaches the reduced diameter portion 1624 of the cavity 1623. An aperture 1626 passes through the sleeve 1619 across the cavity 1623 at a distance just past the length of the fitting 1622 such that when the fitting 1622 is placed in the cavity 1623 a second pin 1627 may be inserted through the aperture 1626 locking the fitting 1622 within the cavity 1623.

The fitting 1622 may be a sleeve swaged to the flexible pendant 1609, a spelter socket, or in other embodiments it may be a different enlarged diameter portion such as a change in a braid or weave of a flexible pendant 1609. The enlarged diameter portion is preferably formed without looping the flexible pendant 1609 on itself which may reduce the strength of the flexible pendant 1609.

In the swaging process the sleeve is passed over the flexible pendant 1609 to a desired location. The sleeve is then deformed around the flexible pendant 1609 to affix it in place. Additional sleeves may be swaged to the flexible pendant 1609 to form multiple fittings.

In some embodiments, the fitting 1622 may be a spelter socket formed on an end of a cable. In such embodiments, the flexible pendant may be formed from multiple sections of cable. A first section is configured to couple to the suspension assembly at a first end and has a first spelter socket on the opposite end. The spelter socket receives a broomed end of the cable and is filled with a filler material such as molten zinc. The molten zinc hardens in place maintaining the broomed shaped of the cable and holding the cable within the spelter socket. A first end of a second section of cable is inserted into a second spelter socket coupled to the first spelter socket. The first end of the second section is broomed and the filler material is poured into the spelter socket holding the second section in place. An end termination in the form of a third spelter socket may be placed on an opposite end of the second section, or the third spelter socket may have a fourth spelter socket coupled to it for receiving another section of cable. Multiple sections of cable may be coupled together using this procedure until a desired number of fittings is obtained.

The fitting 1622 may be removed from the cavity 1623 by removing the second pin 1627 and sliding the fitting 1622 from the cavity 1623. The flexible pendant 1609 can then be removed by sliding it out of the sleeve slot 1625. The effective length of the flexible pendant 1609 may be adjusted by inserting different fittings within the cavity 1623.

Embodiments of the invention are further directed to a method for erecting a crane using the described intermediate suspension connection column segment. In the method, at least three boom segments are assembled end to end with at least one of the boom segments having an intermediate suspension connection between the ends of the boom segment. The at least three boom segments are then coupled end to end to form a suspension column. A first end of the assembled suspension column is then coupled to a hinge pivot point, such as a pivot point on a rotating bed or a pivot point on an end of a boom. A plurality of suspension members are then coupled end to end to form a suspension to connection a second end of the assemble suspension column to a mast. A suspension element is then coupled between the intermediate suspension connection and the suspension. The suspension is then tensioned to lift the second end of the boom. The mast may be a live mast in which tensioning the suspension members is done by rotating the mast proximate the carbody, or it may be a fixed mast in which instance tensioning the suspension is done by shortening a distance between the mast and the suspension.

It should be understood that various changes and modifications to the presently preferred embodiments described herein will be apparent to those skilled in the art. For example, instead of two separate post inserts being used a single post insert spanning the two posts may be used. Or the flexible pendant could be replaced with a single rigid pendant that did not expand. Additionally the suspension connection could be mounted on a location other than the lower cross member so long as it is disposed between the two ends of the boom insert.

The invention claimed is:

1. An intermediate suspension connection column segment configured to be coupled to a first adjacent column segment and to a second adjacent column segment, wherein the intermediate suspension connection column segment is for use in constructing a column formed from a plurality of column segments, wherein the column is supported by a suspension assembly that is configured to be coupled to the intermediate suspension connection column segment with a pendant, the intermediate suspension connection column segment comprising:

a) a first end having a first connection configured to connect to the first adjacent column segment;

b) a second end opposite the first end, the second end having a second connection configured to connect to the second adjacent column segment;

c) a first lower chord, a second lower chord, a first upper chord, and a second upper chord, and a plurality of structural elements, wherein each of the plurality of structural elements is coupled to two of the first lower chord, the second lower chord, the first upper chord, and the second upper chord;

d) a lower cross member extending between the first lower chord and the second lower chord, wherein the lower cross member is positioned between the first end and the second end of the intermediate suspension connection column segment;

e) a first upper cross member and a second upper cross member, wherein each of the first upper cross member and the second upper cross member extend between the first upper chord and the second upper chord; and, f) an intermediate suspension connection disposed upon the lower cross member, wherein the intermediate suspension connection is configured to couple the pendant between the suspension assembly and the intermediate suspension connection column segment, and wherein the pendant is configured to extend between the first upper cross member and the second upper cross member when the pendant is coupled between the suspension assembly and the intermediate suspension connection column segment.

2. The intermediate suspension connection column segment of claim 1, wherein the first connection comprises two first column connectors and two second column connectors, and the second connection comprises two third column connectors and two fourth column connectors.

3. The intermediate suspension connection column of claim 1 wherein the intermediate suspension connection comprises a tab having an aperture disposed therein.

4. The intermediate suspension connection column segment of claim 1 further comprising at least one pendant storage assembly disposed within the intermediate suspension connection column segment.

5. The intermediate suspension connection column segment of claim 4 wherein the at least one pendant storage assembly comprises a box coupled to the intermediate suspension connection.

6. The intermediate suspension connection column segment of claim 1 further comprising at least a first strap assembly stored on an upper surface of the intermediate suspension connection column segment and the pendant stored within the intermediate suspension connection column segment.

7. A column assembly comprising a plurality of column segments coupled end to end with at least one column segment being the intermediate suspension connection column segment of claim 1 and the suspension assembly attached adjacent an end of the column assembly and coupled to the intermediate suspension connection column segment through an intermediate suspension.

8. A crane comprising:

a) a column formed of a plurality of column segments coupled end to end;

b) a suspension assembly coupled to an end of the column;

c) an intermediate suspension connection column segment positioned between and coupled to a first adjacent column segment and a second adjacent column segment of the plurality of column segments, the intermediate suspension connection column segment including:

i. a first end having a first connection configured to connect to the first adjacent column segment;

ii. a second end opposite the first end, the second end having a second connection configured to connect to the second adjacent column segment; and iii. a first lower chord, a second lower chord, a first upper chord, and a second upper chord, and a plurality of structural elements, wherein each of the plurality of structural elements is coupled to two of the first lower chord, the second lower chord, the first upper chord, and the second upper chord;

iv. a lower cross member extending between the first lower chord and the second lower chord, wherein the lower cross member is positioned between the first end and the second end of the intermediate suspension connection column segment;

v. a first upper cross member and a second upper cross member, wherein each of the first upper cross member and the second upper cross member extend between the first upper chord and the second upper chord; and, vi. an intermediate suspension connection disposed upon the lower cross member, d) a pendant coupled to the suspension assembly and the intermediate suspension connection, wherein the pendant extends between the first upper cross member and the second upper cross member.

9. The crane of claim 8, wherein the suspension assembly comprises a first strap assembly and a second strap assembly, wherein the first strap assembly, the second strap assembly, and the pendant are coupled together.

10. The crane of claim 8, wherein the suspension assembly comprises a first strap assembly and a second strap assembly, and a link couples the first strap assembly, the second strap assembly, and the pendant together.

11. The crane of claim 8, further comprising a mast extending laterally from the column and wherein the suspension assembly couples the mast to the end of the column.

12. The crane of claim 8, wherein the intermediate suspension connection comprises a tab having an aperture disposed therein, and wherein the pendant has a connector configured to be coupled to the tab.

* * * * *